United States Patent [19]

Vallee et al.

[11] Patent Number: 4,779,752

[45] Date of Patent: Oct. 25, 1988

[54] PORTABLE FILING BOX

[76] Inventors: Philippe Vallee, 1835 Cr. Tolstoi, Brossard, Quebec, Canada, J4W 3G1; Daniel I. Baghdassarian, 130 cr. De Languedoc, St. Lambert, Quebec, Canada, J4S 1T3

[21] Appl. No.: 137,664

[22] Filed: Dec. 24, 1987

[51] Int. Cl.[4] ..... B65D 1/24; B65D 1/36; B65D 57/00

[52] U.S. Cl. ..... 220/22.1

[58] Field of Search ..... 220/22, 22.1; 206/425, 206/561, 456

[56] References Cited

U.S. PATENT DOCUMENTS

| | | | |
|---|---|---|---|
| 2,556,529 | 6/1951 | Farrell . | |
| 2,663,417 | 12/1953 | Kincaid . | |
| 3,554,429 | 1/1971 | Cohen | 220/22 |
| 3,672,490 | 6/1972 | Desmarais et al. . | |
| 4,375,263 | 3/1983 | Dworkin . | |
| 4,602,715 | 7/1986 | Sarrer et al. | 220/22 |

FOREIGN PATENT DOCUMENTS

| | | |
|---|---|---|
| 688342 | 6/1964 | Canada . |
| 927330 | 5/1973 | Canada . |
| 1030918 | 5/1978 | Canada . |

*Primary Examiner*—George T. Hall

*Attorney, Agent, or Firm*—Foley & Lardner, Schwartz, Jeffery, Schwaab, Mack, Blumenthal & Evans

[57] ABSTRACT

There is disclosed a portable box intended for the filing of papers such as thin flexible credit card receipts and the like. It comprises a container into which is slid and snugly fitted a lining insert having at least two opposed side panels and a bottom panel. The insert panels, which line corresponding walls of the container, are formed with parallel grooves running continuously transversely and opening into the upper borders of the side panels. Flat partition members are slid into these grooves so as to define compartments having openings for the filing of papers. A closure member is snugly fitted into the container, freely resting over the panel upper borders, and is formed with appropriate slots giving access to the compartments as well as with inner furrows into which the upper ends of the partition members are housed. Finally, the container and insert are surrounded by a case to give the box the appearance of a book, which case includes a cover closing over the closure member.

8 Claims, 2 Drawing Sheets

PORTABLE FILING BOX

BACKGROUND OF THE INVENTION

1. Field of the Invention

The present invention generally relates to filing boxes and more specifically to a portable filing box for use by people having to keep an accurate account of business expenses, particularly travelling expenses carried by credit cards.

2. Disclosure of the Prior Art

Filing boxes of the above general type are known and are intended commercially for a wide variety of uses. They may also be used for private purposes for filing away household bills, receipts, important documents and the like. Regardless of its use, the box must be portable, sturdy, attractive and simple in construction so that it can be manufactured at low cost. A search of the prior art, concerned with the particular new features of the present invention as hereinafter disclosed, has been made which has revealed the following patents:

| Canadian Patents | U.S. Patents |
|---|---|
| 688,342 June 9, 1964 | 2,556,529 June 12, 1951 |
| 927,330 May 29, 1972 | 2,663,417 Dec. 22, 1953 |
| 1,030,918 May 9, 1978 | 3,672,490 June 27, 1972 |
| | 4,375,263 March 1, 1983 |

Of the above, U.S. Pat. No. 4,375,263 to Dworkin would appear to be the most pertinent as it relates to a compartmentalized file box for use as a working box for bank personnel and the like who dispense travelers cheques that are arranged in precounted security packaged amounts or bundles so that they may accurately and efficiently be handled. For this purpose, the box contains a plurality of U-shaped dividers of which the bottom or bight of each divider is secured to the bottom of the box while the side members or legs, that define the filing compartments, are hinged to the bight and free to flex with respect to the sides of the box, as in some large floor filing cabinets. While this flexing of the side members may be useful or necessary in this case, where papers in bundles are to be filed, the box can only be used with its bottom laying flat, as if it were used upright, the side members would deflect downwardly and the bundles would fall out of the box, should the cover be accidentally opened. The box is further of complicated costly construction and generally not suited for the filing of unattached papers.

U.S. Pat. No. 3,672,490 to Desmarais discloses a box for storing slides. It involves a tray received in a box and formed with a plurality of partitions spaced lengthwise of the box and defining compartments. A series of U-shaped ribs project from the partitions and from the bottom of the tray, inwardly of the compartments, and serve as supports for storing slides which are of course otherwise self-sustaining. This arrangement would be completely unsuitable for storing flexible papers such as the thin credit card receipts which would rapidly fall off the ribs, considering further that the flexible papers may not have the necessary width to reach the opposed ribs and be supported by them.

Similar remarks apply to the disclosure of Canadian Pat. No. 1,030,918 to Berkman for use in storing magnetic tape enclosures. In this patent, the compartments intended to contain the magnetic tape enclosures are also defined by thin U-shaped ribs projecting inwardly of the compartments from opposed side walls and from the bottom wall of an insert mounted in the storage box. Again, while the thin ribs can easily retain the self-sustaining magnetic tape enclosures, they are unsuitable for the filing of papers.

The remaining patents cited above do not have any relevance with respect to the present invention and therefore need not be discussed here.

SUMMARY OF THE INVENTION

The present invention broadly relates to a portable box intended for the filing of papers such as thin flexible credit card receipts and the like. It comprises a container into which is slid and snugly fitted a lining insert having at least two opposed side panels and a bottom panel. The insert panels, which line corresponding walls of the container, are formed with parallel grooves running continuously transversely and opening into the upper borders of the side panels. Flat partition members are slid into these grooves so as to define compartments having openings for the filing of papers. A closure member is snugly fitted into the container, freely resting over the panel upper borders, and is formed with appropriate slots giving access to the compartments as well as with inner furrows into which the upper ends of the partition members are housed. Finally, the container and insert are surrounded by a case to give the box the appearance of a book, which case includes a cover closing over the closure member.

More specifically, the invention is a portable filing box, comprising:

a rectangular container having upright front, rear and end walls, the walls terminating into an upper peripheral edge;

an insert slidably and snugly fitted into the container; wherein the insert includes a bottom panel, a front panel and a rear panel with the front and rear panels lining the front and rear walls of the containers, respectively, and having flat upper borders terminating short of the container peripheral edge by a predetermined distance;

wherein the insert panels are formed with a series of parallel grooves, each groove running continuously transversely of the front, bottom and rear panels and opening into the flat borders;

a plurality of flat partition members equal in number to the number of the grooves, the partition members being slidably and removably fitted into the grooves and having upper portions projecting above the panel flat borders a distance smaller than the predetermined distance, the flat portion members and the bottom, front and rear panels thereby defining filing compartments having openings along the panel flat borders for filing papers into the compartments;

a closure member snugly fitted into the container and freely resting over the flat borders, the closure member being formed with spaced through slots registering with the compartment openings and being further formed with spaced inner furrows between the slots, the furrows receiving the projecting portions of the partition members, and a case having a base, a back and a cover, the base being fixed to the container around the lower peripheral edge of the container walls; the back being fixed to the container rear wall and the cover being hinged to the back for movement between a closed condition of the container and an open condition thereof.

A description now follows of a preferred embodiment of the invention having reference to the appended drawings.

DESCRIPTION OF THE PREFERRED EMBODIMENT

Figure 1:
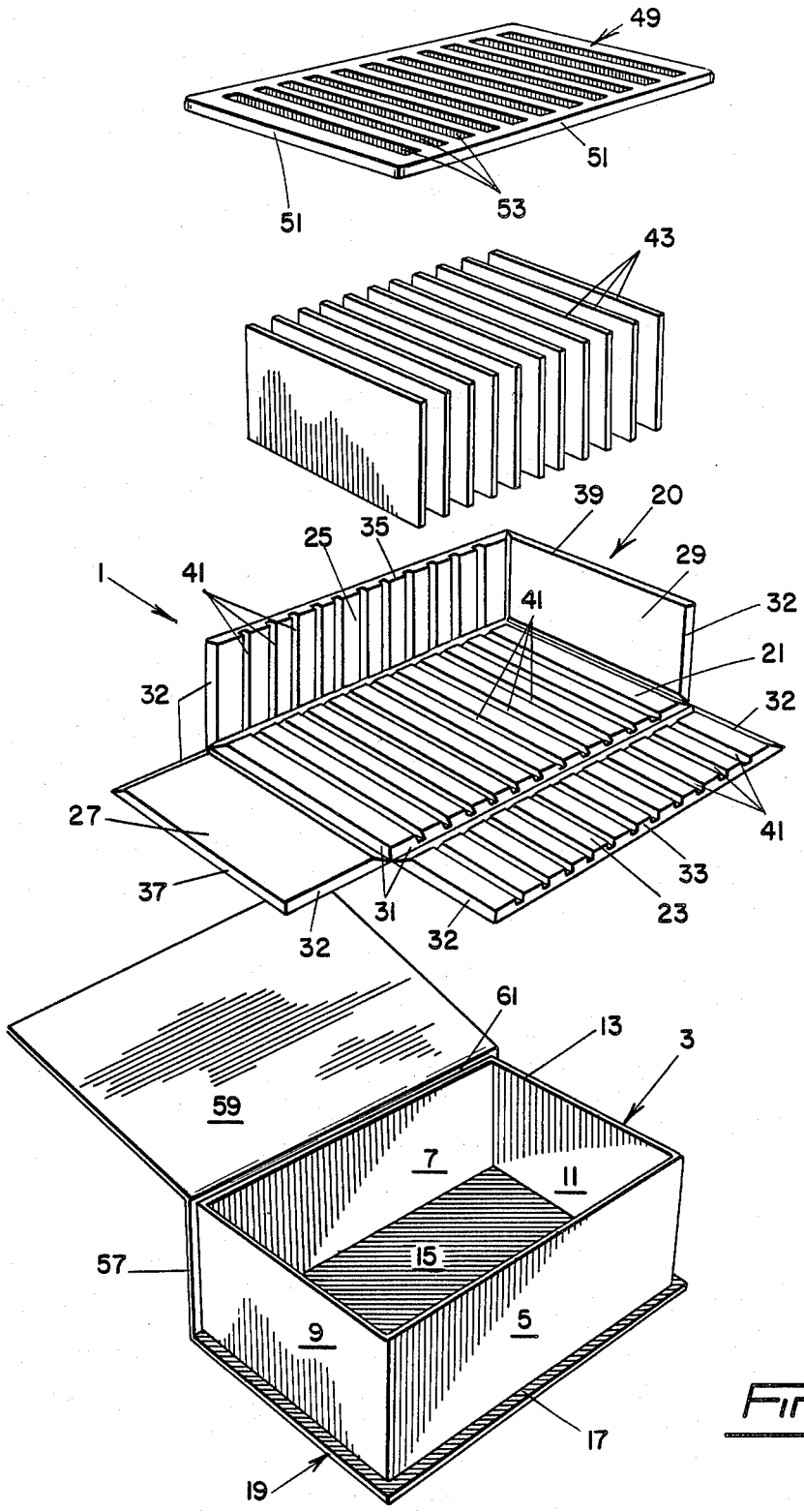
FIG. 1 is an exploded perspective view of the embodiment.

The shown portable filing box 1 comprises a rectangular container 3 having an upright front wall 5, an upright rear wall 7 and upright end walls 9 and 11; these walls terminating into a flat upper peripheral edge 13. Container 3 may have its own bottom wall 15 or else its lower peripheral edge may be secured directly to the base 17 of a case 19 to which reference will be made again hereinafter.

Figure 2:
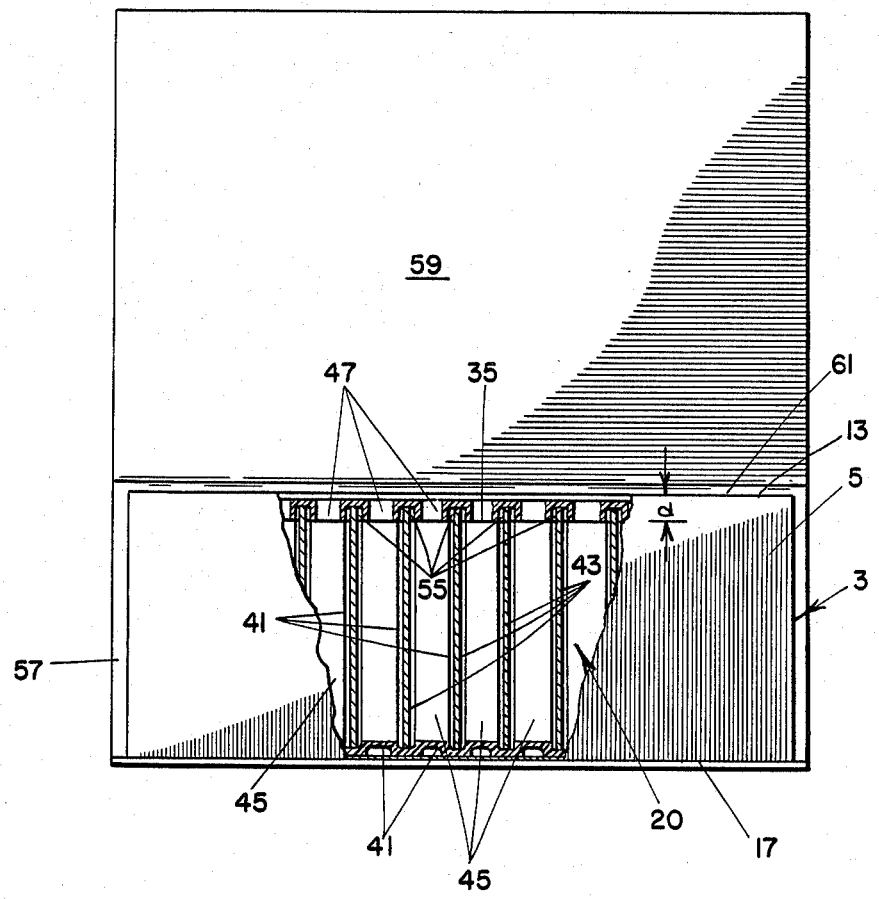
FIG. 2 is a front elevation view with a portion broken away to show the inner structure and with the cover in open position.

An insert 20 is made to be slidably and snugly positioned within the container 3, as shown in FIG. 2, so as to be safely held in it but yet easily removable. It is made of a blank sheet of plastic material press-molded to form a unitary piece comprising a bottom panel 21, a front panel 23, a rear panel 25 and, preferably also, end panels 27 and 29; panels 23 to 29 being connected to bottom panel 21 by hinges 31 integral with the blank sheet. The hinges 31 are formed by outwardly projecting edges of pairs of adjoining panels 21, 23 - 21, 25 - 21, 27 and 21, 29, which edges are bevelled at 45° so that, when the panels 23 to 29 are uprighted, they become perpendicular to the base panel 21 and, because of the bevels, do not tend to bend inward. For the same reason, the upright edges 32 of panels 23 to 29 are likewise bevelled at 45°. All panels 23 to 29 have flat upper borders 33, 35, 37, 39, outwardly turned and terminating short of the peripheral edge 13 a predetermined distance d, when the insert 20 is slid into the container 3. Thus, the insert 20 serves as a lining for the container 3.

Insert panels 21, 23 and 25 are pressformed with a series of parallel grooves 41, preferably evenly spaced along the length of the container 3; each groove running continuously transversely of the panels and opening into the flat borders 33, 35, as shown. End panels 27 and 29 are devoid of such grooves and, in fact, said panels 27, 29, could be avoided but are preferably used to give the insert 20 greater rigidity.

Removably slid into the grooves 41 are flat partition members 43, equal in number to the number of grooves 41. As illustrated in FIG. 2, the partition members 43 project above the flat upper borders 33 to 39 of the panels 23 to 29 a distance which is smaller than the distanced. These flat partition members 43, along with panels 21, 23, 25, thus define filing compartments 45 having openings 47, along the panel flat borders 33, 35, for the insertion of papers to be filed, such as credit card receipts.

A closure member 49 is made to fit snugly into the container 3 so as to be firmly held yet removable. Member 49 rests freely, by a downwardly turned peripheral edge 51, over the flat upper borders 33 to 39 of the panels 23 to 29. The closure member has elongated through slots 53 which register with the compartment openings 47 and further has inner furrows 55 between the slots 53; the furrows receiving the projecting portions of the partition members 43. These furrows may be obtained by inwardly bending the edges of the slots 53, as shown in FIG. 2.

As mentioned before, the base 17 of the case 19 may serve as a bottom wall for the container 3 or the latter may have its own bottom wall 15 secured to the base 17. The case 19 further has a back 57 fixed to the container rear wall 7 and a cover 59; the latter being connected to the back 57 by an integral hinge 61 for movement of the cover between a closed and an open condition of the container 3.

To give the filing box 1 a neat appearance such as that of a book, the cover 59 is made flat and, in closed condition of the box, the base 17, the back 57 and the cover 59 of the case 19 extend slightly beyond the container walls 5 to 11 as shown in FIG. 1.

We claim:

1. A portable filing box, comprising:

a rectangular container having upright front, rear and end walls, said walls terminating into an upper peripheral edge;

an insert slidably and snugly fitted into said container; wherein said insert includes a bottom panel, a front panel and a rear panel with said front and rear panels lining said front and rear walls of said containers, respectively, and having flat upper borders terminating short of said container peripheral edge by a predetermined distance;

wherein said insert panels are formed with a series of parallel grooves, each groove running continuously transversely of said front, bottom and rear panels and opening into said flat borders;

a plurality of flat partition members equal in number to the number of said grooves, said partition members being slidably and removably fitted into said grooves and having upper portions projecting above said panel flat borders a distance smaller than said predetermined distance, said flat portion members and said bottom, front and rear panels thereby defining filing compartments having openings along said panel flat borders for filing papers into said compartments;

a closure member snugly fitted into said container and freely resting over said flat borders, said closure member being formed with spaced through slots registering with said compartment openings and being further formed with spaced inner furrows between said slots, said furrows receiving the projecting portions of said partition members, and a case having a base, a back and a cover, said base being fixed to said container around the lower peripheral edge of said container walls; said back being fixed to said container rear wall and said cover being hinged to said back for movement between a closed condition of said container and an open condition thereof.

2. A portable filing box according to claim 1, wherein said grooves and partition members are evenly spaced along the length of said rectangular container.

3. A portable filing box according to claim 1, wherein said container comprises a bottom wall secured to said base of said case.

4. A portable filing box according to claim 1, wherein said insert further comprises a pair of end panels between said front and rear panels, said end panels terminating into flat upper borders coplanar with said upper borders of said front and rear panels.

5. A portable filing box according to claim 4, wherein said cover is flat and lies, in closure condition of said box, flatly against said flat upper borders.

6. A portable filing box as claimed in claim 4, wherein said insert is molded from a single flat sheet of plastic material and forms a unitary part.

7. A portable filing box according to claim 6, wherein said bottom panel of said insert is connected to said front, rear and end panels by hinges integral with said sheet of plastic material and said front, rear and end panels are free of each other.

8. A portable filing box according to claim 7, wherein said cover is flat and wherein said base, said back and said cover, in closed condition of said box, extend beyond said container walls wherein to give said box the appearance of a book.

* * * * *